US005711896A

United States Patent [19]

Kaimai

[11] Patent Number: 5,711,896

[45] Date of Patent: Jan. 27, 1998

[54] POLYOXYALKYLENE GLYCOL LUBRICATING OILS, WORKING FLUID COMPOSITIONS AND METHODS OF LUBRICATING

[75] Inventor: Takashi Kaimai, Toda, Japan

[73] Assignees: Japan Energy Corporation, Tokyo; Nissan Motor Co., Ltd., Yokohama, both of Japan

[21] Appl. No.: 681,491

[22] Filed: Jul. 23, 1996

Related U.S. Application Data

[63] Continuation of Ser. No. 333,334, Nov. 2, 1994, abandoned.

[30] Foreign Application Priority Data

Nov. 5, 1993 [JP] Japan ..... 5-276916

[51] Int. Cl.[6] ..... C09K 5/00; C10M 105/08

[52] U.S. Cl. ..... 252/68; 508/579

[58] Field of Search ..... 252/68; 508/579

[56] References Cited

U.S. PATENT DOCUMENTS

| | | | |
|---|---|---|---|
| 4,248,726 | 2/1981 | Uchinuma et al. | 508/304 |
| 4,267,064 | 5/1981 | Sasaki et al. | 252/52 A |
| 4,900,463 | 2/1990 | Thomas et al. | 252/52 R |
| 4,948,525 | 8/1990 | Sasaki et al. | 252/52 A |
| 4,971,712 | 11/1990 | Gorski et al. | 252/52 A |
| 5,027,606 | 7/1991 | Short | 252/68 |
| 5,032,305 | 7/1991 | Kamakura et al. | 252/68 |
| 5,279,752 | 1/1994 | Hasegawa et al. | 508/304 |

FOREIGN PATENT DOCUMENTS

| | | |
|---|---|---|
| 386851 | 9/1990 | European Pat. Off. . |
| 421765 | 4/1991 | European Pat. Off. . |
| 533 165 | 3/1993 | European Pat. Off. . |
| 547 870 | 6/1993 | European Pat. Off. . |
| 2182163 | 12/1973 | France . |
| 1-259094 | 10/1989 | Japan . |
| 1-259095 | 10/1989 | Japan . |
| 2-272097 | 11/1990 | Japan . |
| 3-24197 | 2/1991 | Japan . |
| 3-33192 | 2/1991 | Japan . |
| 3-109492 | 5/1991 | Japan . |
| 4-39394 | 2/1992 | Japan . |
| 5-55498 | 2/1992 | Japan . |

*Primary Examiner*—Margaret Medley

*Attorney, Agent, or Firm*—Oliff & Berridge, P.L.C.

[57] ABSTRACT

A lubricating oil for a fluorinated hydrocarbon-based refrigerant type compressor, said lubricating oil having a kinematic viscosity at 100° C. being 15 to 30 cSt and comprising, as a base oil, at least one polyoxyalkylene glycol derivative represented by the following formula (I):

$$R_1—O—[(PO)p(EO^1)q]—(EO^2)r—R_2 \quad (I)$$

in which $R_1$ is an alkyl group having 1 to 4 carbon atoms, $R_2$ is a hydrogen atom or an alkyl group having 1 to 4 carbon atoms, PO is an oxypropylene group, $EO^1$ and $EO^2$ are oxyethylene groups, p, q and r are average polymerization degrees of PO, $EO^1$ and $EO^2$, respectively, $[(PO)p(EO^1)q]$ is a random copolymer group of PO and $EO^1$, $(EO^2)r$ is a block polymer group of $EO^2$, p/(p+q) is 0.70 to 0.95, and r/(p+q+r) is 0.03 to 0.30. A lubricating method and a working fluid composition for the fluorinated hydrocarbon-based refrigerant type compressor are also disclosed.

18 Claims, No Drawings

POLYOXYALKYLENE GLYCOL LUBRICATING OILS, WORKING FLUID COMPOSITIONS AND METHODS OF LUBRICATING

This is a continuation of application Ser. No. 08/333,334 filed Nov. 2, 1994, now abandoned.

BACKGROUND OF THE INVENTION (1) Field of the Invention

The present invention relates to lubricating oils, a lubricating method and a working fluid composition for a fluorinated hydrocarbon based refrigerant compressors. More particularly, the invention relates to lubricating oils, a lubricating method and a working fluid composition for compressors using a fluorinated hydrocarbon-based refrigerant containing no chlorine atom, such as R32, R125, R134, R134a (1,1,1,2-tetrafluoroethane), R143a, and R152a.

(2) Related Art Statement

Although the chlorine-containing fluorinated hydrocarbon-based refrigerants such as chlorofluorocarbons or hydrochlorofluorocarbons have been widely used as refrigerants in home refrigerators, air conditioners, refrigerators, and air conditioners, their uses will be limited for the purpose of protecting the environment. In place of these chlorine-containing fluorinated hydrocarbon-based refrigerants, non-chlorinated refrigerants (hydrofluorocarbons) are considered as promising replacing refrigerants. As typical compounds therefor, R134a (1,1,1,2-tetrafluoroethane) is attracting public attention. As a lubricating oil suitable for the non-chlorinated refrigerant, mineral oil-based lubricants cannot be used. Under the circumstances, a number of polyol ester-based compounds and polyoxyalkylene glycol-based compounds (hereinafter abbreviated as "PAG"s) have been proposed.

The lubricating oils (refrigerator-lubricating oils) used together with refrigerants have different required properties depending upon uses and use conditions. For example, the lubricating oils for car air conditioners are required to have good solubility in the refrigerant particularly on a higher temperature side, not to speak a lower temperature side. Since the car air conditioner is operated under severe and vigorously changing conditions, the lubricating oils are required to have higher lubricity and higher wear resistance for various metallic materials such as iron, copper, and aluminum. Among them, since the rotary type car air conditioner compressor needs to maintain higher sealingness as compared with a swash-plate type car air conditioner compressor, the former requires a lubricating oil to have a higher viscosity. Further, the car air conditioner compressor requires wear resistance, particularly for aluminum materials. It is needless to say that the lubricating oils essentially need lower pour points with respect to any use.

The techniques for the lubricating oils for the non-chlorinated based refrigerants using a PAG as a base oil were proposed in Japanese patent application Laid-open No. 1-259,094, 1-259,095, 3-109492, 3-24,197 and 3-33,192.

Japanese patent application Laid-open No. 4-39,394 describes a dimethylether structure having a formula: $CH_3$—O—$(C^2H^4O)x$—$(RO)^y$—$CH_3$. Hereinafter, a PAG having alkyl groups at opposite ends is referred to as "diether structure", whereas a PAG having an alkyl group and a hydrogen atom at opposite ends, respectively, being "monoether structure".

Further, Japanese patent application Laid-open No. 4-55498 discloses a monoether structure or a diether structure having a formula: $R_1$—$(AO)_n$—$R)_2$. Japanese patent application Laid-open No. 2-272,097 discloses a mono-ether structure having a formula: R—O—$(EO)_m$—$(PO))_n$—H. However, if refrigerator-lubricating oils having a high viscosity, for example, a kinematic viscosity at 100° C. of not less than 15 cSt, or 18 cSt, is to be produced by using such formerly known PAGs, their pour points become higher and such lubricating oils form "cloud" through the production of fine crystals at room temperatures, resulting in practical problems. Furthermore, these refrigerator-lubricating oils are likely to suffer reduction in solubility in fluorinated hydrocarbon-based refrigerants. Moreover, they have insufficient lubricity such as wear resistance for aluminum materials used in vanes or rotors of the compressor.

SUMMARY OF THE INVENTION

The present invention is therefore to reduce the problems of the conventional PAG-based refrigerator-lubricating oils, and to provide lubricating oils which have low pour points even at high viscosity, do not form "cloud", have excellent solubility in refrigerants, and excellent lubricity for not only iron-based materials but also aluminum-based materials.

Further, the invention is to provide excellent lubricating oils for a so-called retrofit use in which a refrigerant containing no chlorine, such as R134a, which is to be charged into a compressor originally charged with a chlorine-containing refrigerant, for example R12, as in the case of an air conditioner of an already marketed vehicle. More particularly, the invention is to provide a lubricating oil excellent for a room air conditioner or a car air conditioner.

Furthermore, the present invention is to provide a method for lubricating the compressor by using the above-mentioned lubricating oils.

In addition, the invention is to provide a working fluid composition for the fluorinated hydrocarbon based refrigerator type compressor, said composition comprising the above lubricating oil and the refrigerants.

The present inventors have made investigations to solve the problems possessed by the above conventional PAG-based refrigerator-lubricating oils. As a result, the inventors have reached the invention. That is, the present inventors have discovered that the problems can be solved by the lubricating oil for a fluorinated hydrocarbon based refrigerant type compressor, said lubricating oil having a kinematic viscosity at 100° C. being 7 to 30 cSt and comprising, as a base oil, at least one polyoxyalkylene glycol derivative represented by the formula (I):

$$R_1—O—[(PO)p(EO^1)q]—(EO^2)r—R_2 \quad (I)$$

in which $R_1$ is an alkyl group having 1 to 4 carbon atoms, $R_2$ is a hydrogen atom or an alkyl group having 1 to 4 carbon atoms, PO is an oxypropylene group, $EO^1$ and $EO^2$ are oxyethylene groups, p, q and r are average polymerization degrees of PO, $EO^1$ and $EO^2$, respectively, $[(PO)p(EO^1)q]$ is a random copolymer group of PO and $EO^1$, $(EO^2)r$ is a block polymer group of $EO^2$, $p/(p+q)$ is 0.70 to 0.95, and $r/(p+q+r)$ is 0.03 to 0.30.

As one of embodiments, there is a provision of the lubricating oil for the fluorinated hydrocarbon based compressor, which lubricating oil uses, as a base oil, a mixture composed of the polyoxyalkylene glycol derivative (a1) of the formula (I) having $R_2$=an alkyl group having 1–4 carbon atoms, such as a methyl group or an ethyl group, and the polyoxyalkylene glycol derivative (a2) of the formula (I) having $R_2$=hydrogen atom.

Further, as another embodiment the lubricating oil for the fluorinated hydrocarbon based refrigerant type compressor comprises, as the base oil, a mixture of at least one polyoxyalkylene glycol derivative (a) represented by the formula (I) and at least one polyoxyalkylene glycol derivative (b) represented by the following formula (II), ratios of a: b being 95:5 to 5:95 in terms of weight, $$R_3—O—(PO)m—(EO)n—R_4 \quad (II)$$

in which $R_3$ is an alkyl group having 1 to 4 carbon atoms, $R_4$ is a hydrogen atom or an alkyl group having 1 to 4 carbon atoms, PO is an oxypropylene group, EO is an oxyethylene group, m and n are average polymerization degrees of PO and EO, respectively, (PO)m is a block Copolymer group of PO, (EO)n is a block polymer group of EO, n/(m+n) is 0.02 to 0.4.

The present invention further relates to the method for lubricating the compressors by using the above lubricating oil and to the working fluid composition for the fluorinated hydrocarbon-based refrigerant type compressor using the above lubricating oil. A methyl group and/or an ethyl group may be preferred as the alkyl groups having 1 to 4 carbons employed in the present invention for reasons mentioned later.

DETAILED DESCRIPTION OF THE INVENTION

The present invention will be explained below in more detail.

The polyoxyalkylglycol derivatives represented by the formula (I) or (II) (hereinafter referred to as "PAG derivatives") in the present invention are all copolymers of oxyethylene groups (hereinafter referred to as "$EO^{1}$", "$EO^{2}$" or merely "EO") and oxypropylene groups (hereinafter referred to as "PO"). The PAG derivatives of the formula (I) and (II) are the copolymers of EO and PO. In the actual use, since a mixture having a molecular weight distribution is used, p, q, r, m and n are average polymerization degrees, which are numbers of the oxyethylene groups and oxypropylene groups constituting an average copolymer. The values of p, q, r, m and n are appropriately selected to satisfy the above-mentioned relational inequalities specifying the relation among them under due consideration of the use or viscosity mentioned later.

The PAG derivatives represented by the formula (I) used in the present invention have the structure in which the random copolymer group $[(PO)p(EO^1)q]$ in which the oxypropylene groups and the oxyethylene groups are copolymerized at specified ratios is bound with the block polymer group of the oxyethylene groups represented by $(EO^2)r$ at the specified ratios. These PAG derivatives may have the diether structure in which one of the terminal end , $R_2$, is a $C_{1-4}$ alkyl group, the other terminal being replaced by a $C_{1-4}$ alkyl group. The PAG derivatives may have the monoether structure in which one of the terminals, $R_2$, is a hydrogen atom, the other terminal $R_1$ is substituted by a $C_{1-4}$ alkyl group.

In the PAG derivative represented by the formula (I), the number of the oxypropylene groups PO in the random copolymer group $[(PO)p(EO^1)q]$ must be greater than that of the oxyethylene groups EO. Their molar ratio: p/(p+q) is 0.70 to 0.95. If the molar ratio is greater than 0–95, the phenomenon called "cloud" that fine crystals come out even at room temperature is likely to occur in the case of a lubricating oil having a high viscosity, and further the pour point increases. Therefore, the lubricating oil having the molar ratio of more than 0.95 is not preferable as the lubricating oil. Furthermore, the above ratio is inpreferably less than 0.70, because hygroscopicity becomes greater in this case. From the standpoints of the cloud phenomenon, the pour point and the hygroscopicity, the above ratio is preferably 0.75 to 0.95, more preferably 0.82 to 0.93, most preferably 0.86 to 0.90. It is particularly important that the PO and $EO^1$ in the group $[(PO)p(EO^1)q]$ are random copolymerized in order to produce a lubricating oil difficult to produce cloud even at a high viscosity.

The $(EO^2)r$ group in the PAG derivative represented by the formula (I) is the block polymer of the oxyethylene. As mentioned before, one end of this group is connected to the group $[(PO)p(EO^1)q]$ and the other being bound with the group $R_2$. The $(EO^2)r$ may be 1 to 6 oxyethylene groups polymerized on the average. If the average number r of the polymerized oxyethylene groups is too large, the pour point is unfavorably higher. The average number r is preferably in a range of 1–5, and more preferably in a range of 2–4. The ratio of r/(p+q+r) in the PAG derivative of the formula (I) is in a range of 0.03 to 0.30, preferably 0.05 to 0.20, most preferably 0.07 to 0.15.

The total percentage of the oxyethylene groups in the PAG derivative of the formula (I), that is, (q+r)/(p+q+r) is preferably 0.08 to 0.30, more preferably 0.08 to 0.25, and more preferably 0.15 to 0.25, from the total standpoint that the hygroscopicity needs to be kept low, the lubricity needs to be improved, the pour point needs to be kept low, and the clouding needs to be prevented.

Further, as mentioned before, the PAG derivative of the formula (I) has either the diether structure or the monoether structure depending upon the terminal group $R_2$. As the alkyl group, a methyl group is preferred, and the diether structure with the methyl groups at the opposite ends ($R_1=R_2=CH_3$) is particularly preferred. The hydroxyl group structure in which the opposite terminals are OH-groups has great hydroscopicity, and poor solubility in the fluorinated hydrocarbon-based refrigerant on the higher temperature side, and sufficient lubricity between aluminum parts at a sliding section cannot be ensured. From the standpoint of the solubility at high temperatures, the diether structure is particularly preferred.

The bonding order of the $[(PO)p(EO^1)q]$ and the $(EO^2)r$ is not structually meaningless in the case of the diether. In the case of the monoethers, the $[(PO)p(EO^1)q]$ group and the $(EO^2)r$ are bonded in the order shown in the formula (I). In this case, high lubricity can be obtained.

The viscosity of the PAG derivative represented by the formula (I) may be appropriately selected to meet a intended use. From the standpoint of uses, the lubricating oils having the kinematic viscosity at 100° C. of 10–30 cSt and the average molecular weight of about 900 to about 3000 are preferred. Particularly, as the lubricating oils for rotary type compressor, the lubricating oils having the kinematic viscosity at 100° C. of 15–30 cSt and the average molecular weight of about 1300 to about 3000 is preferred. Further, as the lubricating oils for swash-plate type compressor, the lubricating oils having the kinematic modulus at 100° C. of 7–25 cSt and the average molecular weight of about 700 to about 2500 is preferred.

The PAG derivatives represented by the formula (I) in the present invention may be produced by a known process. For example, propylene oxide and ethylene oxide are mixed at given mixing ratios, and the resulting mixture is random copolymerized by using an alkali metal salt of methanol or ethanol as an initiator to obtain a random copolymer $R_1—O—[(PO)p(EO^1)q]—H$. To this copolymer is addition polymerized a given amount of ethylene oxide, thereby obtaining a PAG derivative having the monoether structure of the present invention. A PAG derivative having the diether structure may be obtained by converting the hydroxyl group at the terminal end of the monoether structure PAG derivative to a methylether or ethylether structure. The thus obtained PAG derivative is purified and dried by appropriate means.

When the PAG derivative represented by the formula (I) is used as a base oil for a refrigerator-lubricating oil, the monoether structure PAG derivative and the diether structure PAG derivative may be used each singly, but they may be used in combination with each other. Further, a plural kinds of PAG derivative having different viscosities obtained by varying the polymerization degree may be produced, and these may be used in an appropriate combination depending upon uses.

The PAG derivative having the diether structure (a1) represented by the formula (I) in the present invention has particularly excellent fluidity at low temperatures. The PAG derivative (a2) having the monoether structure has particularly excellent lubricity. Accordingly, a lubricating oil having a totally excellent performance can be obtained by mixing the PAG derivative (a1) having the monoether structure with the PAG derivative (a2) having the monoether structure at a ratio of 10:90 to 90:10 in terms of weight.

Furthermore, in order to meet uses and exhibit necessary functions, a mixture in which the PAG derivative having the formula (I) and the PAG derivative having the following formula (II) are mixed at a ratio of 95:5 to 5:95 in terms of weight may be used as a based oil.

$$R_3—O—(PO)m—(EO)n—R_4 \quad (II)$$

in which $R_3$ is an alkyl group having 1 to 4 carbon atoms, $R_4$ is a hydrogen atom or an alkyl group having 1 to 4 carbon atoms, PO is an oxypropylene group, EO is an oxyethylene group, m and n are average polymerization degrees of PO and EO, respectively, (PO)m is a block polymer group of PO, (EO)n is a block polymer group of EO, n/(m+n) is 0.02 to 0.4.

The PAG derivative of the formula (II) has the block copolymer structure between PO and EO. From the standpoint of reducing in the pour point and improving the lubricity, it is preferable that m is 10–20, n is 1–4, and n/(m+n) is 0.02 to 0.4, more preferably 0.03 to 0.3, and most preferably 0.05 to 0.25. From the standpoint of the performance, such as the pour point at low temperatures, the kinematic modulus at 100° C. of the PAG derivative of the formula (II) is preferably 5–20 cSt, more preferably 5–15 cSt. If the kinematic modulus at 100° C. is more than 20 cSt, the clouding phenomenon is likely to occur. Furthermore, the PAG derivative of the formula (II) in which $R_4$ is a hydrogen atom has more excellent lubricity when the block polymerization is carried out in the order shown in the formula (II).

The lubricity of the PAG derivative of the formula (II) is improved by mixing the PAG derivative the formula (I) therewith. The PAG derivative of the formula (I) is mixed with that of the formula (II) in a range of 95:5 to 5:95 (weight ratio) to make the viscosity at 100° C. to be a desired value of 7–30 cSt. From the total performance, the mixing ratio is preferably 90:10 to 50:50 (weight ratio). When both kinds of the PAG derivatives are mixed in the range of 95:5: to 5:95, the lubricating oil which does not cause the clouding problem and which extremely improve lubricity for iron materials and aluminum materials in compressor bearings, vanes, casing, etc. can be obtained. Thus, the above PAG derivative mixture can be applied particularly preferably as the lubricating oil for the rotary type or reciprocating type car air conditioners which are to be driven under conditions which are severer and severer due to compacting requirements, weight-reducing requirements, and efficiency improvement.

Although the ratio between the fluorinated hydrocarbon-based refrigerant and the refrigerator-lubricating oil changes depending upon the type of the compressor for the room air conditioner or the car air conditioner or the use thereof, the ratio of the fluorinated hydrocarbon-based refrigerant/the lubricating oil is generally 95/5 to 40/60 in weight. Excellent lubricating function can be exhibited in this case.

The lubricating oils according to the present invention can be used as lubricating oils to cover a wide kinematic viscosity range of 7 to 30 cSt at 100° C. Among them, the lubricating oils of the invention having the formula (I) have low pour points even at high viscosity, do not form cloud, are stably dissolved into the non-chlorinated hydrocarbon-based refrigerant over a wide temperature range, and possess excellent lubricity. Therefore, such lubricating oils are particularly useful lubricating oils having high kinematic-viscosities of 20–30 cSt at 100° C. Further, the lubricating oils formed by mixing the PAG derivatives of the formulae (I) and (II) also have low pour points and excellent lubricity such as high wear resistance, particularly high lubricity for the aluminum materials. Further, the lubricating oils formed by mixing the PAG derivatives having the diether structure of the formula (I) and the PAG derivatives having the monoether structure of the formula (II) have low pour points, high lubricity and excellent solubility in the refrigerants.

The lubricating oils for use in the fluorinated hydrocarbon-based refrigerant type refrigerators have excellent solubility in the non-chlorinated fluorinated hydrocarbon-based refrigerants (such as R32, R125, R134, R134a, R143a and R152a), or the fluorinated hydrocarbon refrigerants having a small content of chlorine (such as R22) over an extremely wide ratio. When the lubricating oils of the invention are to be used as a so-called retrofit type lubricating oil which is to be charged into a compressor designed for a conventional chlorine-containing refrigerant as a non-chlorinated refrigerant in exchange of a chlorinated refrigerant, the invention lubricating oils can favorably exhibit excellent lubricity.

When the PAG derivative having the formula (I) of the invention is used singly or as a mixed refrigerator-lubricating oil in combination with the PAG derivative of the formula (II), various kinds of additives may be added. For example, additives generally known for conventional fluorinated hydrocarbon refrigerant type refrigerator-lubricating oils, e.g., an extreme pressure agent and an anti-wear agent such as tricresyl phosphate (TCP) or tricresyl phosphite, an anti-oxidant such as 2,4-ditertiary butyl paracresol (DBPC), an acid-capturing agent such as alkyl-, alkenyl- or phenyl-, or epoxy-polyalkylene glycol derivative, a copper-corrosion preventing agent such as benzotriazole, and a defoaming agent such as silicone oil may be added in necessary amounts. Further, one or more conventionally known PAG-based compounds, for example, monoalkyl ethers or dialkyl ethers of polyoxypropylene glycols, monoalkyl ethers or dialkyl ethers of polyoxyethylene propylene glycols may be mixed as an auxiliary base oil in such an amount as not deteriorate the function of the refrigerator-lubricating oil of the present invention.

As mentioned above, the refrigerator-lubricating oils of the present invention have solved the conventional problems possessed by the PAG-based refrigerator oils, and have low pour points even at the high viscosities, stable solubility in the fluorinated hydrocarbon-based refrigerants, form no clouding, and excellent lubricity for iron materials and aluminum materials. The refrigerator-lubricating oils of the invention are suitable as the lubricating oils particularly for the compressors in the car air conditioners to be used under severe conditions, that is, the rotary type compressor or the swash-plate type compressor.

EXAMPLES AND COMPARATIVE EXAMPLES

In the following, the present invention will be explained with reference to examples and comparative examples, but the invention is not limited to those examples at all.

The following Table 1 shows Compound Nos. 1 through 8 used. Compound NOS. 1 through 3 each have the diether structure containing a random block copolymer group. Compound NO. 4 has the monoether structure having a random block copolymer group. Compound Nos. 5 and 6 each have the monoether structure containing a block polymer group only. Compound Nos. 7 and 8 each has the diether structure containing a block polymer only. The suffixes p, q, r, n and m, which are figures indicating average polymerization degrees, are shown as ratios among them. The kinematic modulus is given in cSt unit at 100° C.

Compound Nos. 1 through 8 were used singly or in a mixed state as lubricating oils as lubricating oils in Examples 1 through 7 and Comparative Examples 1 through 4. With respect to these lubricating oils, the kinematic viscosity, the pour point, mixing stability with R134a (two-phase separation temperature and clouding at room temperature) and lubricity (wearing bearings, etc.) were measured or evaluated, and results are shown in Table 2.

TABLE 1

| Compound | Formula | $R_1$ | $R_2$ | $R_3$ | $R_4$ | p:q:r | n:m | Dynamic viscosity (cSt) |
|---|---|---|---|---|---|---|---|---|
| 1 | (I) | $CH_3$ | $CH_3$ | — | — | 8:1:1 | — | 19.0 |
| 2 | (I) | $C_2H_5$ | $CH_3$ | — | — | 8:1:1 | — | 21.5 |
| 3 | (I) | $CH_3$ | $CH_3$ | — | — | 8:1.25:0.75 | — | 21.9 |
| 4 | (I) | $CH_3$ | H | — | — | 8:1:1 | — | 19.0 |
| 5 | (II) | — | — | $CH_3$ | H | — | 8:2 | 11.5 |
| 6 | (II) | — | — | $CH_3$ | H | — | 8:2 | 20.2 |
| 7 | (II) | — | — | $CH_3$ | $CH_3$ | — | 8:2 | 9.4 |
| 8 | (II) | — | — | $CH_3$ | $CH_3$ | — | 10:0 | 19.0 |

TABLE 2

| | Lubricant oil | Dynamic viscosity (cSt) | Pour point | Two-phase separation temperature (°C.) lower temp. side | Two-phase separation temperature (°C.) higher temp. side | Clouded or not at room temperature | Worn amount of bearings (μm) | Content of metal in lubricating oil (ppm) iron | Content of metal in lubricating oil (ppm) aluminum |
|---|---|---|---|---|---|---|---|---|---|
| Example | | | | | | | | | |
| 1 | compound 1 (100%) | 19.0 | −42.5 | less than −50 | 49 | not clouded | 5.2 | less than 1 | less than 1 |
| 2 | compound 2 (100%) | 21.5 | −45.0 | less than | 45 | not clouded | 4.8 | less than 1 | less than 1 |

TABLE 2-continued

| | Lubricant oil | Dynamic viscosity (cSt) | Pour point | Two-phase separation temperature (°C.) lower temp. side | Two-phase separation temperature (°C.) higher temp. side | Clouded or not at room temperature | Worn amount of bearings (μm) | Content of metal in lubricating oil (ppm) iron | Content of metal in lubricating oil (ppm) aluminum |
|---|---|---|---|---|---|---|---|---|---|
| 3 | comoound 3 (100%) | 21.9 | −45.0 | −50 less than −50 | 47 | not clouded | 6.0 | 3 | less than 1 |
| 4 | compound 4 (100%) | 19.0 | −40.0 | less than −50 | 36 | not clouded | 3.0 | less than 1 | less than 1 |
| 5 | compound 1 (60%) compound 5 (40%) | 15.7 | −42.5 | less than −50 | 52 | not clouded | 6.5 | 3 | 2 |
| 6 | compound 2 (85%) compound 6 (15%) | 21.3 | −40.0 | less than −50 | 40 | not clouded | 3.8 | less than 1 | less than 1 |
| 7 | compound 2 (70%) compound 7 (30%) | 15.9 | −45.0 | less than −50 | 52 | not clouded | 7.9 | 5 | 3 |
| 8 | compound 4 (70%) compound 7 (30%) | 15.3 | −42.5 | less than −50 | 46 | not clouded | 4.2 | less than 1 | less than 1 |
| Comparative Example | | | | | | | | | |
| 1 | compound 6 (100%) | 20.3 | −10.0 | insoluble | insoluble | clouded | 3.1 | less than 1 | less than 1 |
| 2 | compound 5 (100%) | 11.5 | −40.0 | less than −50 | 63 | not clouded | 9.5 | 8 | 5 |
| 3 | compound 7 (100%) | 9.4 | −50.0 | less than −50 | 70 | not clouded | 12.0 | 11 | 8 |
| 4 | compound 8 (100%) | 19.0 | −42.5 | less than −50 | 36 | not clouded | 17.4 | 18 | 15 |

Measurements or evaluations were performed in the following ways.

(1) Dynamic viscosity

Dynamic viscosity was measured according to JIS (Japanese Industrial Standard) K 2283.

(2) Pour point

Pour point was measured according to JIS K 2269.

(3) Mixing stability-evaluating test with R134a

With respect to a mixture of a lubricating oil and R134a being 20:80 in weight, two-phase separation temperatures (°C.) were measured on a lower temperature side and on a higher temperature side, respectively, and clouding was observed.

(4) Lubricity

Into a system having a car air conditioner compressor (rotary type refrigerator compressors working fluid contacted iron materials and aluminum materials of the compressor) connected to a motor were charged 0.8 kg of R134a and 0.2 kg of a lubricating oil, and a durability test was effected under the following driving condition. Then, the compressor was disassembled, and wearing and the contents of respective metals in the lubricating oil were analyzed.

Compressor speed: 5000 rpm

Discharge side pressure: 24 kg/cm$^2$

Suction side pressure: 1 kg/cm$^2$

Discharged gas temperature: 145° C.

Driving time period: 200 hours (continuously driven)

In the testing, 0.5 wt. % of DBPC was added, as an antioxidant, into the lubricating oil and 1.0 wt. % of TOP was also added so as to prevent seizuring.

As mentioned above and shown in the Tested Examples, the lubricating oils according to the present invention have the low pour points even at high viscosities, do not form cloud, have excellent solubility in the fluorinated hydrocarbon-based refrigerants on the lower and higher temperature sides, and excellent lubricity for not only the iron materials but also the aluminum materials. Therefore, when such lubricating oils are employed, excellent working fluid compositions for the fluorinated hydrocarbon based refrigerator compressors can be obtained, and the fluorinated hydrocarbon-based refrigerant type compressors can be favorably lubricated.

What is claimed is:

1. A lubricating oil for a fluorinated hydrocarbon based refrigerant type compressor, said lubricating oil having a kinematic viscosity at 100° C. being 15 to 30 cSt and comprising, as a base oil, a mixture of at least one polyoxyalkylene glycol derivative represented by the following formula (I):

$$R_1—O—((PO)p(EO^1)q)—(EO^2)r—R_2 \quad (I)$$

in which $R_1$ is an alkyl group having 1 to 4 carbon atoms, $R^2$ is a hydrogen atom, PO is an oxypropylene group, $EO^1$ and $EO^2$ are oxyethylene groups, p, q and r are average polymerization degrees of PO, $EO^1$ and $EO^2$, respectively, $((PO)_p(EO^1)_q)$ is a random copolymer group of PO and $EO^1$, $(EO^2)r$ is a block polymer group of $EO^2$, p/(p+q) is 0.70 to 0.95, and r/(p+q+r) is 0.03 to 0.30, and at least one polyoxyalkylene glycol derivative (b) represented by the following formula (II), ratios of a:b being 95:5 to 5:95 in terms of weight, $$R_3—O—(PO)m(EO)n—R_4 \quad (II)$$

in which $R_2$ is an alkyl group having 1 to 4 carbon atoms, $R^4$ is a hydrogen atom or an alkyl group having 1 to 4 carbon atoms, PO is an oxypropylene group, EO is an oxyethylene group, m and n are average polymerization degrees of PO and EO, respectively, (PO)m is a block polymer group of PO, (EO)n is a block polymer group of EO, n/(m+n) is 0.02 to 0.4, and wherein said lubricating oil has a molecular weight of at least 1300.

2. The lubricating oil for the fluorinated hydrocarbon based refrigerant type compressor according to claim 1, wherein $R_4$ of the polyoxyalkylene glycol derivative represented by the formula (II) is a hydrogen atom.

3. The lubricating oil for the fluorinated hydrocarbon based refrigerant type compressor according to claim 1, wherein the base oil is a mixture of at least one polyoxyalkylene glycol derivative (a) represented by the formula (I) and at least one polyoxyalkylene glycol derivative (b) represented by the formula (II), and the derivative (a): the derivative (b) are mixed in ratios of 90:10 to 50:50 in terms of weight.

4. The lubricating oil for the fluorinated hydrocarbon based refrigerant type compressor according to claim 1, wherein the kinematic viscosity at 100° of the polyoxyalkylene glycol derivative (a) of the formula (I) is 15–25 cSt, and the kinematic viscosity at 100° C. of the polyoxyalkylene glycol derivative (b) of the formula (II) is 5–20 cSt.

5. The lubricating oil for the fluorinated hydrocarbon based refrigerant according to claim 1, wherein $R_1$ in the formula (I) is a methyl group.

6. The lubricating oil for the fluorinated hydrocarbon based refrigerant type compressor according to claim 1, wherein p/(p+q) is 0.75 to 0.95.

7. A method for lubricating a fluorinated hydrocarbon based refrigerant type compressor, said method comprising the steps of charging, into said compressor, the lubricating oil recited in claim 1, and lubricating said compressor with the lubricating oil together with a fluorinated hydrocarbon based refrigerant.

8. The method for lubricating the fluorinated hydrocarbon based refrigerant type compressor according to claim 7, wherein the refrigerant used in the fluorinated hydrocarbon refrigerant compressor is a fluorinated hydrocarbon refrigerant containing no chlorine.

9. The method for lubricating the fluorinated hydrocarbon based refrigerant type compressor according to claim 7, wherein the fluorinated hydrocarbon based refrigerant is one selected from the group consisting of R22, R32, R125, R134, R134a, R152a, and mixtures thereof.

10. A working fluid composition for lubricating a fluorinated hydrocarbon based refrigerant type compressor, said working fluid composition comprising the lubricating oil recited in claim 1, and a fluorinated hydrocarbon refrigerant.

11. The working fluid composition the fluorinated hydrocarbon based refrigerant type according to claim 10, wherein the refrigerant used in the fluorinated hydrocarbon refrigerant compressor is a fluorinated hydrocarbon refrigerant containing no chlorine.

12. The working fluid composition for the fluorinated hydrocarbon based refrigerant according to claim 10, wherein the fluorinated hydrocarbon based refrigerant is one selected from the group consisting of R22, R32, R125, R134, R134a, R152a, and mixtures thereof.

13. A lubricating oil for a fluorinated hydrocarbon based refrigerant type compressor, said lubricating oil having a kinematic viscosity at 100° C. being 7 to 30 cSt and comprising, as a base oil, a mixture of at least one polyoxyalkylene glycol derivative (a) represented by the following formula (I):

$$R_1—O—((PO)p(EO^1)q)—(EO^2)r—R_2 \quad (I)$$

in which $R_1$ is an alkyl group having 1 to 4 carbon atoms, $R^2$ is a hydrogen atom or an alkyl group having 1 to 4 carbon atoms, PO is an oxypropylene group, $EO^1$ and $EO^2$ are oxyethylene groups, p, q and r are average polymerization degrees of PO, $EO^1$ and $EO^2$, respectively, $((PO)_p(EO^1)_q)$ is a random copolymer group of PO and $EO^1$, $(EO^2)r$ is a block polymer group of $EO^2$, p/(p+q) is 0.70 to 0.95, and r/(p+q+r) is 0.03 to 0.30, and at least one polyoxyalkylene glycol derivative (b) represented by the following formula (II), ratios of a:b being 95:5 to 5:95 in terms of weight, $$R_3—O—(PO)m(EO)n—R_4 \quad (II)$$

in which $R_3$ is an alkyl group having 1 to 4 carbons atoms, $R^4$ is a hydrogen atom or an alkyl group having 1 to 4 carbon atoms, PO is an oxypropylene group, EO is an oxyethylene group, m and n are average polymerization degrees of PO and EO, respectively, (PO)m is a block polymer group of PO, (EO)n is a block polymer group of EO, n/(m+n) is 0.02 to 0.4.

14. The lubricating oil for the fluorinated hydrocarbon based refrigerant type compressor according to claim 13, wherein $R_4$ of the polyoxyalkylene glycol derivative represented by the formula (II) is a hydrogen atom.

15. The lubricating oil for the fluorinated hydrocarbon based refrigerant type compressor according to claim 13, wherein the kinematic viscosity at 100° C. of the polyoxyalkylene glycol derivative (a) of the formula (I) is 15–25 cSt, and the kinematic viscosity at 100° C. of the polyoxyalkylene glycol derivative (b) of the formula (II) is 5–20 cSt.

16. The lubricating oil for the fluorinated hydrocarbon based refrigerant type compressor according to claim 13, wherein $R_1$ and $R_2$ of the polyoxyalkylene glycol derivative represented by the formula (I) are each methyl groups.

17. A method for lubricating a fluorinated hydrocarbon based refrigerant type compressor, said method comprising the steps of charging, into said compressor, the lubricating oil recited in claim 13, and lubricating said compressor with the lubricating oil together with a fluorinated hydrocarbon based refrigerant.

18. A working fluid for lubricating a fluorinated hydrocarbon based refrigerant type compressor, said working fluid composition comprising the lubricating oil recited in claim 13, and a fluorinated hydrocarbon refrigerant.

* * * * *

UNITED STATES PATENT AND TRADEMARK OFFICE

CERTIFICATE OF CORRECTION

PATENT NO. : 5,711,896

DATED : January 27, 1998

INVENTOR(S) : Takashi KAIMAI

It is certified that error appears in the above-indentified patent and that said Letters Patent is hereby corrected as shown below:

Title page, in item [56] FOREIGN PATENT DOCUMENTS, change "5-55498" to --4-55498--.

Signed and Sealed this

Fourteenth Day of April, 1998

Bruce Lehman

*Attest:*

BRUCE LEHMAN

*Attesting Officer*

*Commissioner of Patents and Trademarks*